US008723060B2

(12) United States Patent
Parrinello et al.

(10) Patent No.: US 8,723,060 B2
(45) Date of Patent: May 13, 2014

(54) METHOD AND MECHANISM FOR POWER TOOL LOCK-OFF

(75) Inventors: Jon James Parrinello, Elgin, IL (US); Thomas Costello-Saile, Gerlingen (DE)

(73) Assignee: Robert Bosch Tool Corporation, Broadview, IL (US)

( * ) Notice: Subject to any disclaimer, the term of this patent is extended or adjusted under 35 U.S.C. 154(b) by 136 days.

(21) Appl. No.: 13/333,764

(22) Filed: Dec. 21, 2011

(65) Prior Publication Data

US 2013/0161161 A1 Jun. 27, 2013

(51) Int. Cl.
*H01H 9/28* (2006.01)

(52) U.S. Cl.
USPC ..... 200/43.17; 200/43.11; 200/332.2; 200/334

(58) Field of Classification Search
USPC ..... 200/43.11, 318, 321, 334, 332.2, 505
See application file for complete search history.

(56) References Cited

U.S. PATENT DOCUMENTS

| | | | | |
|---|---|---|---|---|
| 1,249,576 | A | 12/1917 | Wesson | |
| 3,422,296 | A | 1/1969 | Frank | |
| 3,713,242 | A | 1/1973 | Seifried | |
| 3,873,796 | A | 3/1975 | Worobec, Jr. | |
| 4,002,101 | A | 1/1977 | Tellie | |
| 4,879,438 | A | 11/1989 | Winchester | |
| 5,094,000 | A * | 3/1992 | Becht et al. | 30/475 |
| 6,218,633 | B1 | 4/2001 | Okumura et al. | |
| 6,274,828 | B1 * | 8/2001 | Chu | 200/43.17 |
| 6,512,188 | B2 * | 1/2003 | Campbell et al. | 200/321 |
| 6,555,773 | B1 * | 4/2003 | Broghammer et al. | 200/61.85 |
| 6,861,598 | B2 * | 3/2005 | Bascom et al. | 200/43.17 |
| 7,112,751 | B2 * | 9/2006 | Turley | 200/50.32 |
| 7,476,821 | B1 * | 1/2009 | Knuppel | 200/332.2 |
| 8,198,560 | B2 * | 6/2012 | Kimata et al. | 200/318.1 |
| 2005/0218176 | A1 | 10/2005 | Schell et al. | |
| 2006/0124684 | A1 | 6/2006 | Schell et al. | |

FOREIGN PATENT DOCUMENTS

| | | |
|---|---|---|
| GB | 2 209 885 | 5/1989 |

OTHER PUBLICATIONS

International Search Report and Written Opinion for Application No. PCT/US2012/070676, mail date Apr. 8, 2013, 11 pages.

* cited by examiner

*Primary Examiner* — Kyung Lee
(74) *Attorney, Agent, or Firm* — Foley & Lardner LLP

(57) ABSTRACT

Embodiments of the present invention disclosed herein present forms of a method and mechanism for a power tool lock-off, wherein accidental activation of the power tool may be inhibited. Pressing a lock-off release button on the tool housing induces a locking member to move from a first position to a second position, allowing a trigger to access a power switch within the housing. Various forms and methods of lock-off mechanisms are enabled.

20 Claims, 5 Drawing Sheets

METHOD AND MECHANISM FOR POWER TOOL LOCK-OFF

BACKGROUND OF THE INVENTION

The present disclosure relates generally to the field of power tools. More specifically, the present disclosure relates to hand-operated power tools that include a trigger lock-off mechanism.

SUMMARY OF THE INVENTION

One embodiment relates to a power tool. The power tool includes a housing and a trigger configured for movement relative to the housing between a first position and a second position. The tool also includes a switch provided in the housing which is coupled to the trigger and a power source, wherein actuating the trigger from the first position to the second position controls the switch thereby allowing power to flow from the power source to operate the power tool. The tool further includes a lock-off mechanism provided on the housing for actuation between a locked position and an unlocked position. The lock-off mechanism includes a locking pin adapted for movement between a first position blocking movement of the trigger relative to the switch and a second position in which movement of the trigger relative to the switch is not prevented by the locking pin. The lock-off mechanism also includes a release button coupled to the locking pin and provided on the housing for movement between a first position corresponding to the first position of the locking pin and a second position corresponding to the second position of the locking pin. The lock-off mechanism further includes a biasing member that directs the locking pin into the first position blocking movement of the trigger, wherein pressing the release button in a direction into the housing causes the locking pin to rotate into the second position that does not block movement of the trigger.

Another embodiment relates to another power tool with a trigger lock-off mechanism. The tool includes a housing, a trigger for activating the tool, and a locking member within the housing. Activation of the tool may be inhibited by the locking member in a first position. The tool also includes a release button on the housing, wherein pressing the release button pivots the locking member about a rotational axis of the lock-off mechanism and into a second position that does not inhibit activation of the tool.

Yet another embodiment relates to a method of operating a power tool with a trigger lock-off mechanism. The method includes gripping a handle with either the user's right or left hand and pushing a trigger release button to pivot a locking pin. The trigger release button is located along an axis of symmetry of the tool. The method also includes pulling a trigger to actuate a function of the power tool.

DETAILED DESCRIPTION OF THE PREFERRED EMBODIMENTS

Some power tools, such as reciprocating saws, circular saws, chain saws, nail guns, weed wackers, hedge trimmers, power drills, airbrushes, pneumatic drills or jackhammers, and the like, can be activated by pulling a trigger, causing the trigger to slide or rotate relative to a tool housing. However, these tools can also be activated inadvertently by squeezing the trigger, which might occur for example while picking up a hand-held power tool, or while putting weight on the handle of a power tool. As such, some power tools may be equipped with a lock-off mechanism to help prevent inadvertent activation.

Figure 1:
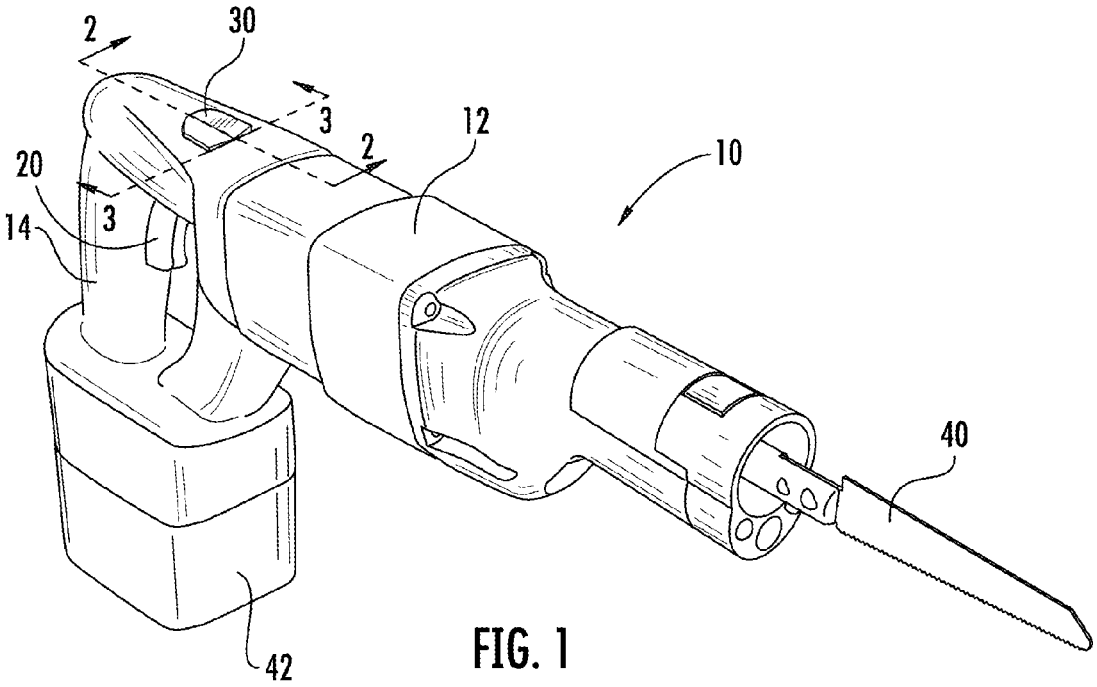
FIG. 1 is a perspective view of a hand-held power tool, specifically a reciprocating saw according to one embodiment.

FIG. 1 shows a perspective view of hand-held power tool, specifically a reciprocating saw 10, having a housing 12 and a handle 14. Tool 10 also includes a power source in the form of a rechargeable, attachable battery pack 42. A trigger 20 is coupled to the handle 14, such that the trigger 20 may slide, rotate or otherwise move relative to the handle 14. Squeezing the trigger 20 inward toward the handle 14, such as with an index finger, activates the power tool 10 causing a saw blade 40 to reciprocate relative to the housing 12.

However, inadvertent activation of the tool 10 could cause the saw blade 40 to be destructive, dangerous, and/or wasteful. As such, tool 10 includes an internal lock-off mechanism (not shown), whereby activation of the tool 10 is prevented until the lock-off is released. A corresponding lock-off release button 30 (or equivalent knob, bump, key, switch, controller, and the like) is mounted on the housing 12. When a user desires to activate tool 10, the user must first release the lock-off mechanism through manipulation of the button 30.

In the embodiment seen in FIG. 1, the positions of the release button 30 and trigger 20 allow for an ambidextrous operation of the tool 10, substantially equally functional for left-handed and right-handed users. For example, the button 30 and the trigger 20 are both positioned substantially symmetrically about the longitudinal center axis of the tool 10, where the button 30 is on the top of the tool housing 12 and the trigger 20 is near the top of the handle 14. A user gripping the tool 10 by the handle 14 would find the button 30 and the trigger 20 to be in the same relative position regardless of the hand the user prefers to grip the tool 10. Similarly, other types of release buttons may be positioned to favor a right- or left-handed user.

In an exemplary embodiment, downward activation (e.g. inward movement relative to the housing 12) of the release button 30 is an ergonomic feature in that it is compatible with natural movements and inclinations of some human operators. For example, some operators of power tools have the inclination to hold the tool tightly, squeezing the handle while operating the tool. Tight control of the tool can be advantageous for safety reasons, because such control may prevent the tool from slipping and/or dropping. Inward pressure on the button 30 is compatible with a stronger grip on the tool handle 14. Conversely, other types of release buttons may require movements ergonomically less compatible with a user, such as sliding of a button laterally relative to the housing, or lifting of a button with a same hand that is also pulling a trigger—neither of which may enhance the user's grip on the tool.

Figure 2:
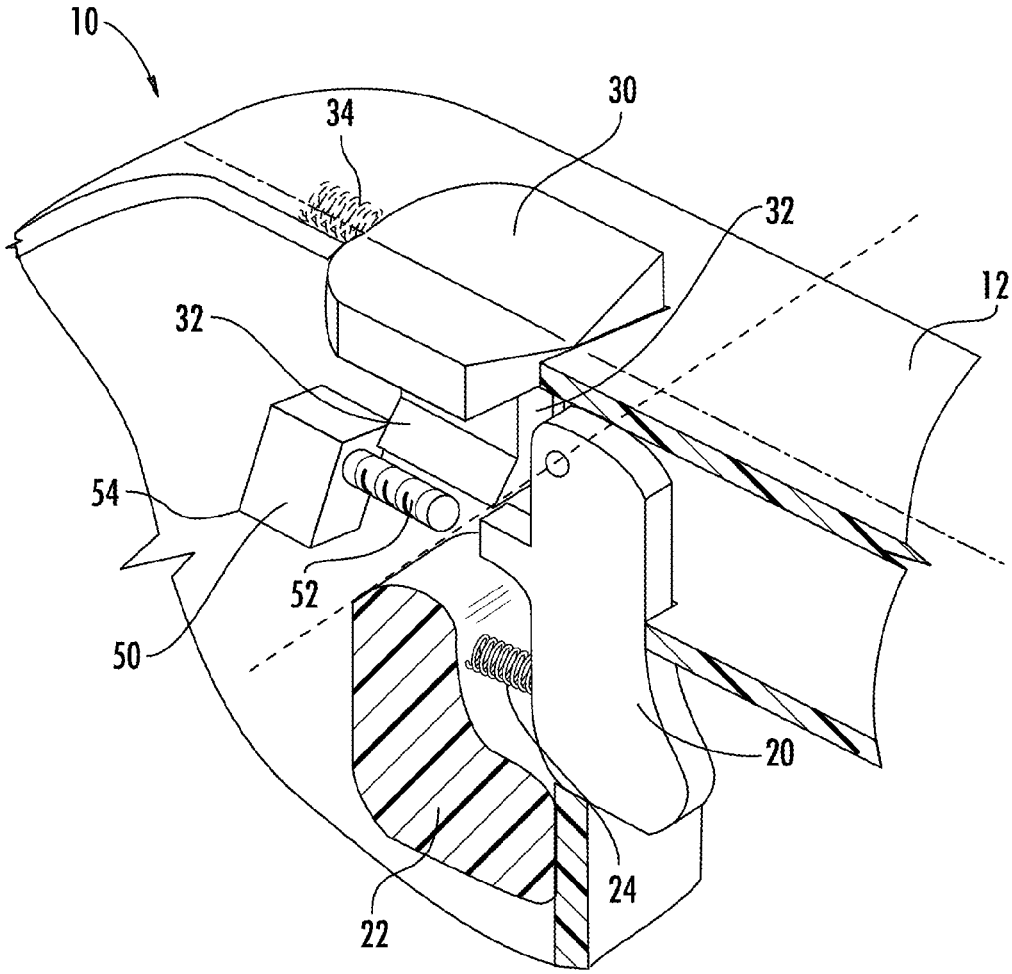
FIG. 2 is a perspective, partial cross-sectional view of a portion of the reciprocating saw power tool shown in FIG. 1 according to one embodiment.

FIG. 2 shows a perspective, partial cross-sectional view of a portion of the reciprocating saw power tool 10 shown in FIG. 1, including the housing 12, the trigger 20, and the release button 30. Internal components of tool 10 include a lock-off mechanism in the form of a locking pin 32, a motor activation switch 50, and a trigger backstop 22. As shown in FIG. 2, the locking pin 32 is coupled to the release button 30, and together they function as a lock-off mechanism. The pin 32 blocks the trigger 20 from rotating into the handle 14. Inward pressure on the release button 30 (e.g., on either side of the release button 30) into the housing will cause the locking pin 32 to move out of a path of the trigger 20, allowing the trigger 20 to be rotated into the handle 14. Stated another way, the trigger moves along a first path and the locking pin moves along a second path, with the first and second paths intersecting one another and being substantially perpendicular to each other.

According to an exemplary embodiment, as the release button is rotated about a rotational axis of the lock-off mechanism, the pin 32 also rotates about the rotational axis to move out of the path of the trigger 20. Stated another way, the release button is pivotable about an axis that is substantially within a plane in which the trigger moves (i.e., the path of the trigger). According to an exemplary embodiment, the rotational axis of the lock-off mechanism is substantially perpendicular to a rotational axis of the trigger. A portion of the trigger 20 may then contact a pressure sensor 52, which is coupled to the switch 50 that activates the tool 10.

Also as shown in FIG. 2, further internal components include biasing members and backstops. For example, movement of the trigger 20 relative to the handle 14 is limited by the backstop 22, which stops the trigger 20 from being rotated too far into the housing 12. A biasing member, such as a compressible spring 24, biases the trigger 20 to return to an original trigger or "off" position when not being squeezed by the user. An additional biasing member, such as torsion spring 34, biases the release button 30 to return to an original button position when not being pressed by the user. Other embodiments with different biasing members include the use of flexible beams as springs, rubber bands, counterweights, and the like. Other embodiments with different backstops use hooks, pins, flanges, and the like.

The switch 50 is an electrical switch which is coupled to the pressure sensor 52 and controls the flow of electricity to an actuator, such as an electric motor, that drives the tool 10. In some embodiments, the switch allows for only a single active mode of the tool 10 (e.g., single speed, power, temperature, voltage, and the like, which depends upon the particular type of tool), but in other embodiments, the switch allows for multiple active modes (e.g., dual speed, tunable voltage, and the like). Additionally, in some embodiments, the switch is not electrical, but instead is mechanical. In still other embodiments, the tool actuator (e.g., motor) is not electric, but is combustion, pneumatic, hydraulic and the like, which depends upon the nature of the power tool.

Figure 3:
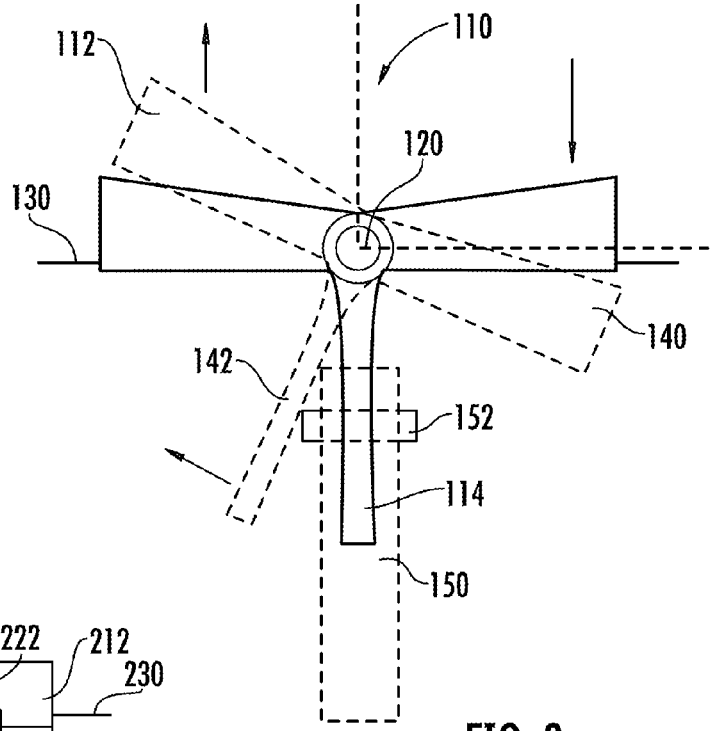
FIG. 3 is a front view of a first embodiment of a lock-off mechanism shown in FIG. 1 according to one embodiment.
Figure 4:
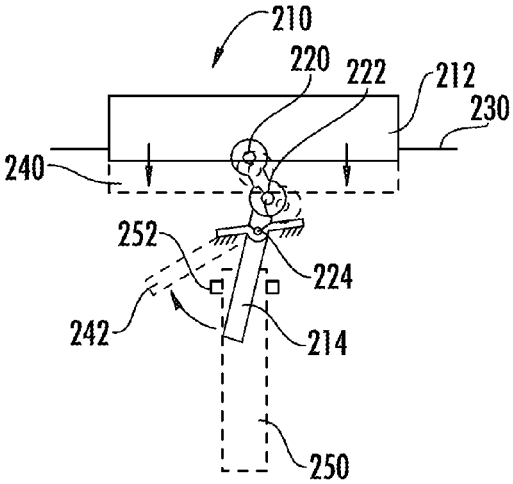
FIG. 4 is a front view of a second embodiment lock-off mechanism according to one invention.
Figure 5:
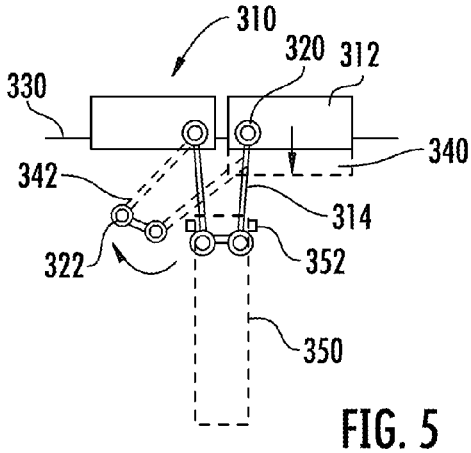
FIG. 5 is a front view of a third embodiment lock-off mechanism according to one invention.

FIGS. 3-5 show three embodiment lock-off mechanisms 110, 210, 310, incorporating buttons 112, 212, 312 coupled to pivoting members 114, 214, 314. While the pivoting members 114, 214, 314 are in a locked position, they block the paths 150, 250, 350 of corresponding triggers, when the triggers are mounted to rotate about pivots 152, 252, 352. A user may unlock the lock-off mechanisms 110, 210, 310 by pressing the buttons 112, 212, 312 to a second position 140, 240, 340. Pressure (e.g., negative or positive) on the buttons 112, 212, 312 causes the members 114, 214, 314 to pivot about hinge pivot points (e.g., rotate about a rotation axis of the buttons), such as hinge pivot 120 on mechanism 110, hinge pivots 220, 222, 224 on mechanism 210, and hinge pivots 320, 322 on mechanism 310. Sufficient pressure on the buttons 112, 212, 312, causes the members 114, 214, 314 to move to unlocked positions 142, 242, 342, out of the trigger paths 150, 250, 350, allowing the triggers to contact tool activation sensors and switches. While FIGS. 3-5 show three different embodiments of lock-off mechanisms, one of ordinary skill in the art will recognize other equivalent mechanisms by way of these examples and the present disclosure falling within the scope of the present invention.

The locking mechanism buttons 112, 212, 312 are surrounded by tool housings 130, 230, 330. In the FIG. 1 reciprocating saw 10 embodiment example, the button 30 was located on the top of the saw 10, in a position where a user may comfortably place a thumb while gripping the handle 14 (i.e., either a left-handed or right-handed user and thumb). Such a comfortably placed location is preferred, but the scope of the present invention includes many other locations, such as further forward on a tool to be gripped by the user's other hand. Still other button embodiments may be pressed by a part of user that is not a thumb, such as a palm, forearm, elbow, and the like.

The lock-off mechanism 110 as seen in FIG. 3 has fewer movable parts compared to other embodiments as seen in FIGS. 4 and 5. The lock-off mechanism 110 also has a simple layout that allows for ease of construction and installation. For example, such a part may be injection molded or cast in one step. Additionally, fewer moving parts may reduce the chance of the mechanism failing. As such, a lock-off mechanism such as embodiment 110 may be more reliable than other multi-component mechanisms.

Figure 6:
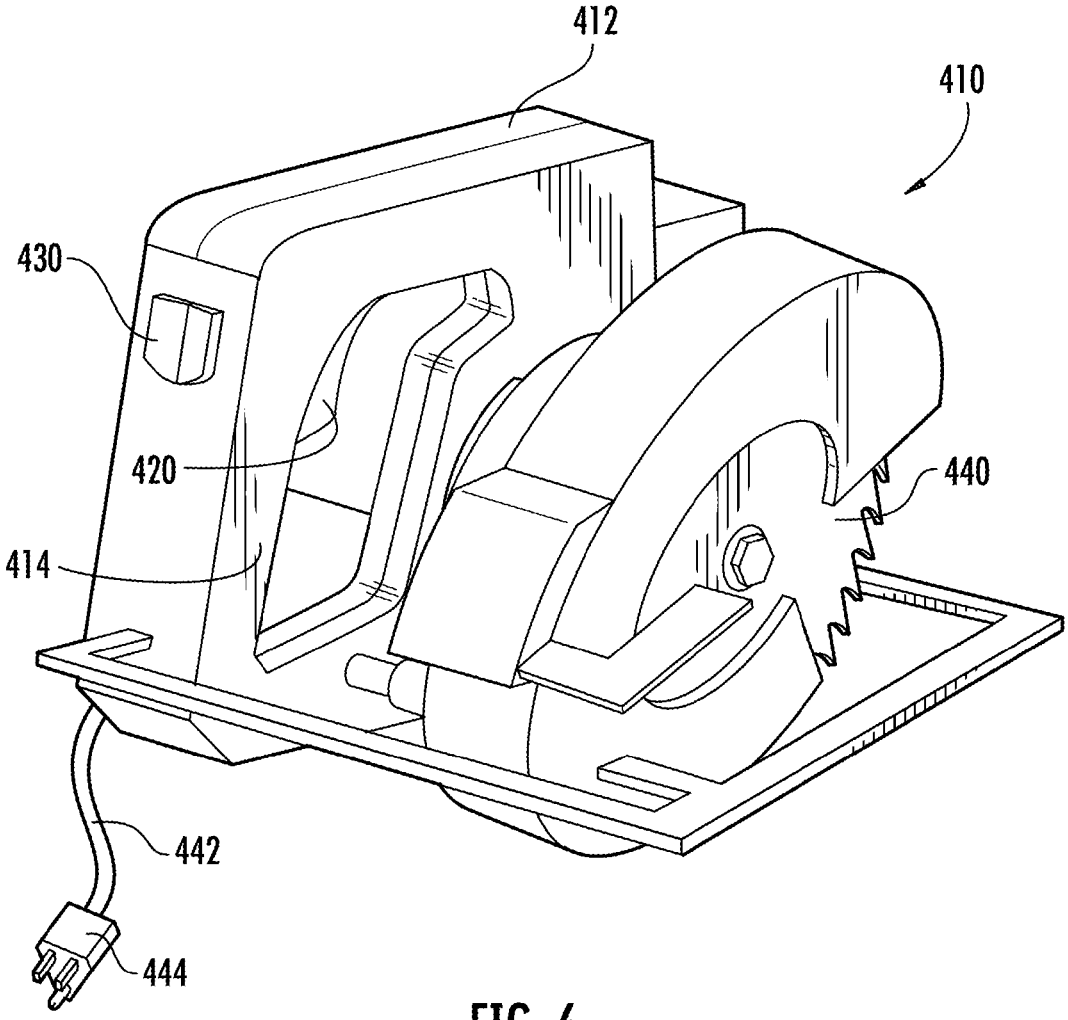
FIG. 6 is a perspective view of circular saw power tool according to one invention.

FIG. 6 shows a perspective view of circular saw embodiment 410, also with a housing 412 and handle 414. Tool 410 also includes a power cord 442 and plug 444 for connection to an electrical outlet. It is understood that other approaches for supplying the power source are possible. In one example, the tool 410 is a corded circular saw. In another example, the tool 410 is a cordless circular saw. A trigger 20 is coupled to the handle 14, such that the trigger 20 may rotate relative to the handle 14. Pulling the trigger 20 inward toward the handle 14 with an index finger, for example, activates the power tool 10 causing a saw blade 40 to reciprocate. Tool 410 includes an internal lock-off mechanism (such as those shown in FIGS. 3-5), whereby activation of the tool 410 is prevented until the lock-off is released. A corresponding lock-off release button 430 is mounted on the housing. Here the lock-off mechanism, such as the mechanism 110, is oriented such that the member pin end would block the trigger path instead of the member pin side. When a user desires to activate tool 410, the user can release the lock-off mechanism through manipulation of the button 430, as discussed above.

In some embodiments lock-off mechanisms can be coupled to a trigger to prevent the trigger from rotating or moving relative to the housing and thus prevent accidental activation. But in other embodiments of the present invention, the lock-off mechanism prevents accidental activation without affecting the trigger. In some exemplary embodiments, lock-off mechanisms engage a tool gearing, or a sensor (such as a pressure sensor) coupled to a switch that controls power to a motor. The lock-off mechanism then prevents the pressure sensor from detecting that a trigger has been squeezed, such as by either (1) preventing the trigger from being able to displace the sensor, (2) preventing the trigger from being able to apply a load to a sensor, or (3) sliding a sensor out of alignment with the trigger.

Figure 7:
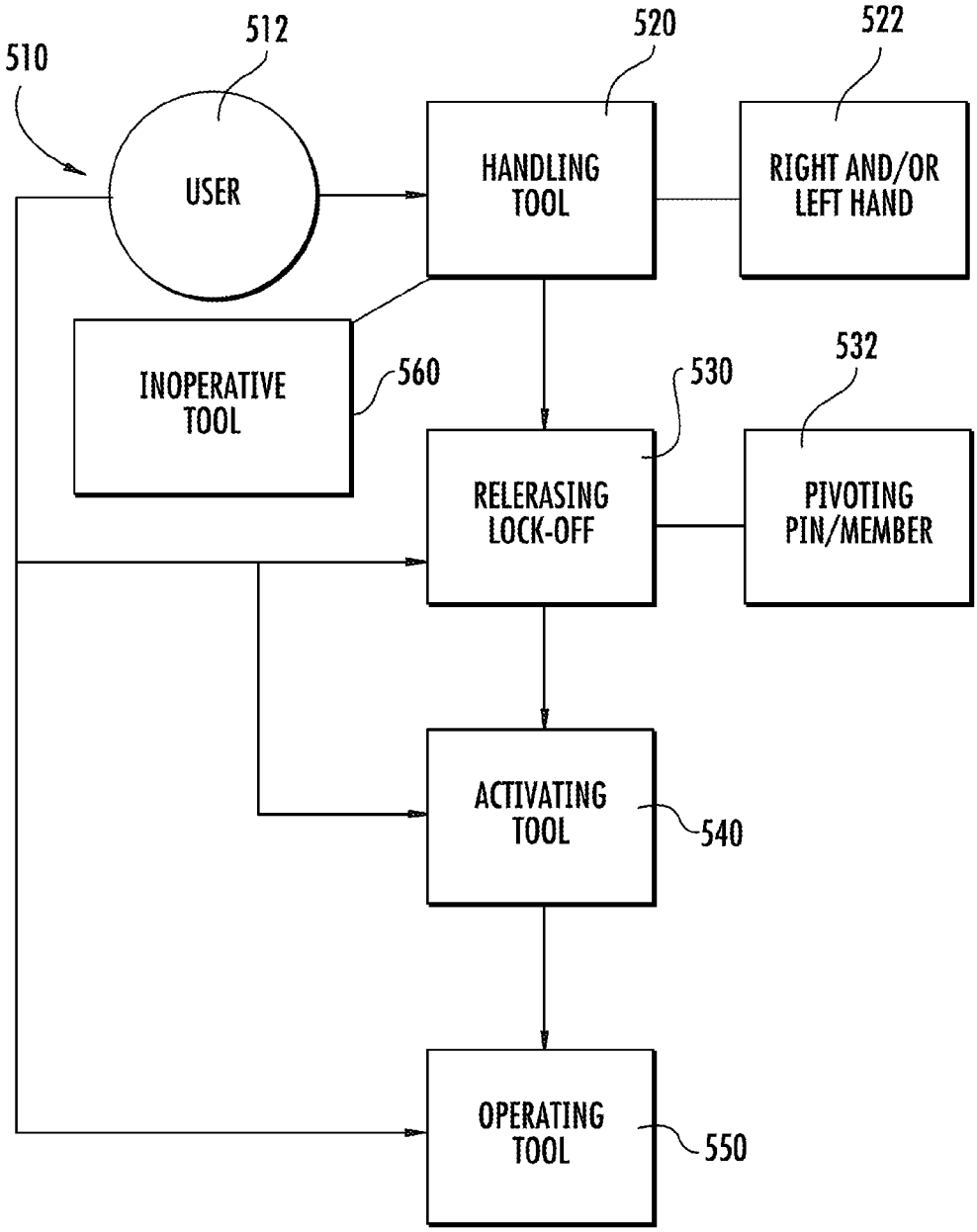
FIG. 7 is a flow chart depicting a method of operation according to one invention.

FIG. 7 presents a flowchart describing one embodiment of a method of operation 510 of a power tool by a user or operator 512. Method 510 includes the steps of a user handling a power tool, such as by gripping (or lifting, grabbing, or the like) a handle 520 with either the user's right or left hand 522. Also, method 510 includes a step of actuating (e.g. pushing down, pressing, pulling, squeezing, rotating, or the like) a trigger release button 530. Additionally, method 510 includes pivoting a lock-off pin (or member, structure, or the like) for the purpose of (1) moving it out of a path of a trigger, (2) allowing a trigger to contact a sensor, or (3) allowing a switch to activate a tool motor 532—i.e., moving a lock-off mechanism from a locked to an unlocked position. Method 510 also includes pulling or squeezing a trigger (or turning an actuator knob, pressing an actuator button, initiating an actuator, or the like) 540 to drive, actuate, or implement a function of the power tool, such as drilling, cutting, hammering, binding, nailing and the like 550. It should be noted that without unlocking 560 the lock-off mechanism, the function of the power tool will be prevented.

One embodiment of the disclosure relates to a power tool. The power tool includes a trigger that is coupled to a power switch and a power source. Pulling the trigger controls the power switch, such that it allows power to flow from the power source to drive the tool. The power tool also includes a lock-off mechanism, which itself includes a locking pin that is coupled to a release button. The release button is positioned on a housing of the tool and a biasing member (e.g., torsion spring) directs the locking pin into a first position which is blocking movement of the trigger. However, pressing the release button into the housing causes the locking pin to move into a second position that does not block movement of the trigger.

Another embodiment of the disclosure relates to another power tool with a trigger lock-off mechanism. The tool includes a tool housing, a trigger for activating the tool, and a locking member within the housing. Activation of the tool may be inhibited by the locking member when the locking member is in a first position. The tool also includes a release button on the housing, such that pressing the release button pivots the locking member into a second position that does not inhibit activation of the tool.

Yet another embodiment of the disclosure relates to a method of operating a power tool with a trigger lock-off mechanism. The method includes several steps. One step includes gripping a handle of the tool, where such gripping may be with either the user's right or left hand. Another step includes pushing down a trigger release button that is located along an axis of symmetry of the tool. Yet another step includes pivoting a lock-off pin. And, another step includes pulling a trigger to actuate a function of the power tool.

For the purposes of this disclosure that the term "coupled" means the joining of two members directly or indirectly to one another. Such joining may be stationary in nature or moveable in nature and/or such joining may allow for the flow of electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. In the context of the controller switch and actuator, coupling generally means coupling components in electric signal communication.

It is also important to note that the construction and arrangement of the elements of the tools and lock-off mechanisms as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, an additional cover or lid could be coupled to a power tool housing, and cover the lock-off release button such that a user would first have to lift the cover before being able to access the button. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A power tool, comprising:

a housing;

a trigger configured for movement relative to the housing between a first position and a second position;

a switch provided in the housing which is coupled to the trigger and a power source, wherein actuating the trigger from the first position to the second position controls the switch thereby allowing power to flow from the power source to operate the power tool;

a lock-off mechanism provided on the housing for actuation between a locked position and an unlocked position and comprising:

a locking pin adapted for movement between a first position blocking movement of the trigger relative to the switch and a second position in which movement of the trigger relative to the switch is not prevented by the locking pin;

a release button coupled to the locking pin and provided on the housing for movement between a first position corresponding to the first position of the locking pin and a second position corresponding to the second position of the locking pin; and a biasing member that directs the locking pin into the first position blocking movement of the trigger, wherein pressing the release button in a direction into the housing causes the locking pin to rotate into the second position that does not block movement of the trigger.

2. The power tool of claim 1, wherein the release button is located on the housing in a location substantially equally accessible to users handling the tool with either a right or a left hand.

3. The power tool of claim 1, wherein the release button is located on the housing in a location along an axis of symmetry of the tool.

4. The power tool of claim 3, further comprising a motorized saw coupled to the power source, wherein pulling the trigger activates the saw.

5. The power tool of claim 3, wherein the power source is an electrical power source.

6. The power tool of claim 5, wherein the power source includes a detachable, rechargeable battery.

7. The power tool of claim 1, wherein the trigger moves along a first path and the locking pin moves along a second path, wherein the first and second paths intersect, and wherein the first and second paths are substantially perpendicular to each other.

8. The power tool of claim 7, wherein the locking pin is coupled to a hinge pivot and pivots along the second path.

9. A power tool with a trigger lock-off mechanism, comprising:

a housing;

a trigger for activating the tool;

a locking member within the housing, wherein activation of the tool may be inhibited by the locking member in a first position; and a release button on the housing, wherein pressing the release button pivots the locking member about a rotational axis of the trigger lock-off mechanism and into a second position that does not inhibit activation of the tool.

10. The power tool of claim 9, wherein the release button is pivotally supported on the housing.

11. The power tool of claim 10, wherein the release button is pivotable about an axis substantially within a plane in which the trigger moves.

12. The power tool of claim 9, wherein the locking member in the first position inhibits a tool power switch from detecting a movement of the trigger.

13. The power tool of claim 9, wherein the locking member in the first position inhibits the trigger from contacting a tool power switch.

14. The power tool of claim 9, wherein the release button is located on the housing such that it is centered about an axis of symmetry of the tool.

15. The power tool of claim 14, wherein pressing the release button in a direction into the housing causes the locking member to pivot.

16. The power tool of claim 9, wherein the trigger moves along a first path and the locking member moves along a second path, wherein the first and second paths are substantially perpendicular to each other.

17. A method of operating a power tool with a trigger lock-off mechanism comprising the following steps:

gripping a handle with either a user's right or left hand;

pushing a trigger release button to pivot a locking pin, wherein the trigger release button is located along an axis of symmetry of the tool; and pulling a trigger to actuate a function of the power tool.

18. The method of claim 17, wherein pushing the trigger release button includes moving the locking pin out of a path of a trigger to allow activation of the tool.

19. The method of claim 17, wherein pushing the trigger release button includes allowing a trigger to access a sensor coupled to a power switch to allow activation of the tool.

20. The method of claim 17, wherein pushing the trigger release button includes rotating the trigger release button about a rotation axis of the trigger lock-off mechanism to allow a power switch to activate the tool.

* * * * *